US006708357B2

(12) United States Patent
Gaboury et al.

(10) Patent No.: US 6,708,357 B2
(45) Date of Patent: Mar. 23, 2004

(54) CORNER PIECE FOR A SOFT-SIDED MATTRESS

(75) Inventors: James D. Gaboury, Andover, MN (US); James E. Gifft, Maple Grove, MN (US); Anna Khoruts, Minneapolis, MN (US); Daniel J. Koughan, Eden Prairie, MN (US)

(73) Assignee: Select Comfort Corporation, Minneapolis, MN (US)

( * ) Notice: Subject to any disclaimer, the term of this patent is extended or adjusted under 35 U.S.C. 154(b) by 0 days.

(21) Appl. No.: 10/047,068

(22) Filed: Jan. 14, 2002

(65) Prior Publication Data

US 2003/0131418 A1 Jul. 17, 2003

(51) Int. Cl.[7] ..... A47C 17/00
(52) U.S. Cl. ..... 5/739; 5/663; 5/680
(58) Field of Search ..... 5/739, 663, 678, 5/679, 680; 248/345.1

(56) References Cited

U.S. PATENT DOCUMENTS 1,088,959 A * 3/1914 Benton ..... 5/739
3,999,236 A 12/1976 Macauley
4,016,612 A 4/1977 Barile, Sr.
4,065,818 A 1/1978 Farina
4,334,331 A * 6/1982 Santo ..... 5/680
4,539,723 A 9/1985 Hillsberry
4,879,775 A * 11/1989 Keefer ..... 5/680
4,901,383 A 2/1990 Yang et al.
4,912,789 A * 4/1990 Maxwell ..... 5/680
4,930,172 A * 6/1990 Johenning ..... 5/688
4,970,743 A 11/1990 Wride et al.
5,819,349 A * 10/1998 Schwartz ..... 5/740

* cited by examiner

*Primary Examiner*—Teri Pham Luu
(74) *Attorney, Agent, or Firm*—Oppenheimer Wolff & Donnelly LLP

(57) ABSTRACT

A rigid corner piece for maintaining the square appearance of a mattress having foam sides. The corner piece anchors two of the foam pieces together to form a butt joint. The corner piece is constructed and arranged to be relatively undetectable by a person sitting on the side of the bed. The corner piece preferably defines a groove into which the two foam pieces may be placed at a relatively right angle to each other.

11 Claims, 4 Drawing Sheets

CORNER PIECE FOR A SOFT-SIDED MATTRESS

BACKGROUND OF THE INVENTION

The device of the present invention pertains to reinforcing the corners of a mattress having soft sides, such as a waterbed or airbed.

Fluid-filled beds are quickly gaining popularity as an alternative sleeping surface to standard spring-based mattresses. This trend began with waterbeds and recent advances in airbed technology have placed airbeds in the forefront of fluid-filled mattresses.

Initial waterbed designs provided a bladder placed into a bed frame having a cavity formed by a solid base and four rigid walls. The bladder was then filled with water and laterally constrained by the rigid walls. The need for a soft-sided waterbed was quickly illuminated as people began bruising their legs on the rigid sides of the bed and found sitting on the edge of the bed extremely uncomfortable.

Soft-sided waterbeds, and now airbeds as well, substitute the rigid side walls of the previous designs with foam walls. The bladders are baffled so that less lateral support is required. The soft, foam sides more closely simulate a conventional spring mattress and virtually eliminate the problems associated with hard-sided waterbeds.

However, the foam sides present a unique problem. Soft foam is an inherently poor construction material. In order to form the soft border, four pieces of foam are laid around the bladder, inside the mattress cover, in such a manner as to form butt joints at the corners. In order to join the members to each other, one solution covers the foam members with a material to which a hook and loop fastener is attached. The hook and loop fastener joins the two members forming each butt joint.

Over a relatively short period of time, the butt joint formed using a hook and loop fastener tends to shift. This shifting gives the corners of the mattress a somewhat soft, sloppy appearance. Moreover, these individual foam covers represent a significant unit cost, which is uneconomical considering their ineffectiveness.

It would thus be desirable to provide a low cost mechanism for joining two foam side members together to form a butt joint that will maintain its shape over time.

BRIEF SUMMARY OF THE INVENTION

The present invention provides a method and mechanism for maintaining a desired orientation of the abutting sides of a soft-sided, fluid-filled bed. The mechanism is inexpensive, easy to manufacture, easy to assemble by the consumer, and usable in any of the four corners of the mattress.

The mechanism generally comprises a plastic 90 degree channel defined by an outer wall, an inner wall, and a bottom. The outer wall is high enough to prevent the foam member from sagging over the wall yet short enough so as to be relatively undetectable by someone sitting on the side of the bed. The inner wall is somewhat shorter than the outer wall to keep material costs to a minimum. The inner wall acts as an anchor to keep the foam members in close proximity to the outer wall. In the case of differing foam thicknesses between the sidewalls and endwalls, the inner wall can be dimensioned accordingly, or an alternative mechanism could be substituted for the innerwall.

In use, the mechanism gives the corner of the mattress a crisp appearance, despite repeated usage. The mechanism also assists in keeping bedding, such as fitted sheets, from slipping off of the corners.

DETAILED DESCRIPTION OF THE INVENTION

Figure 1:
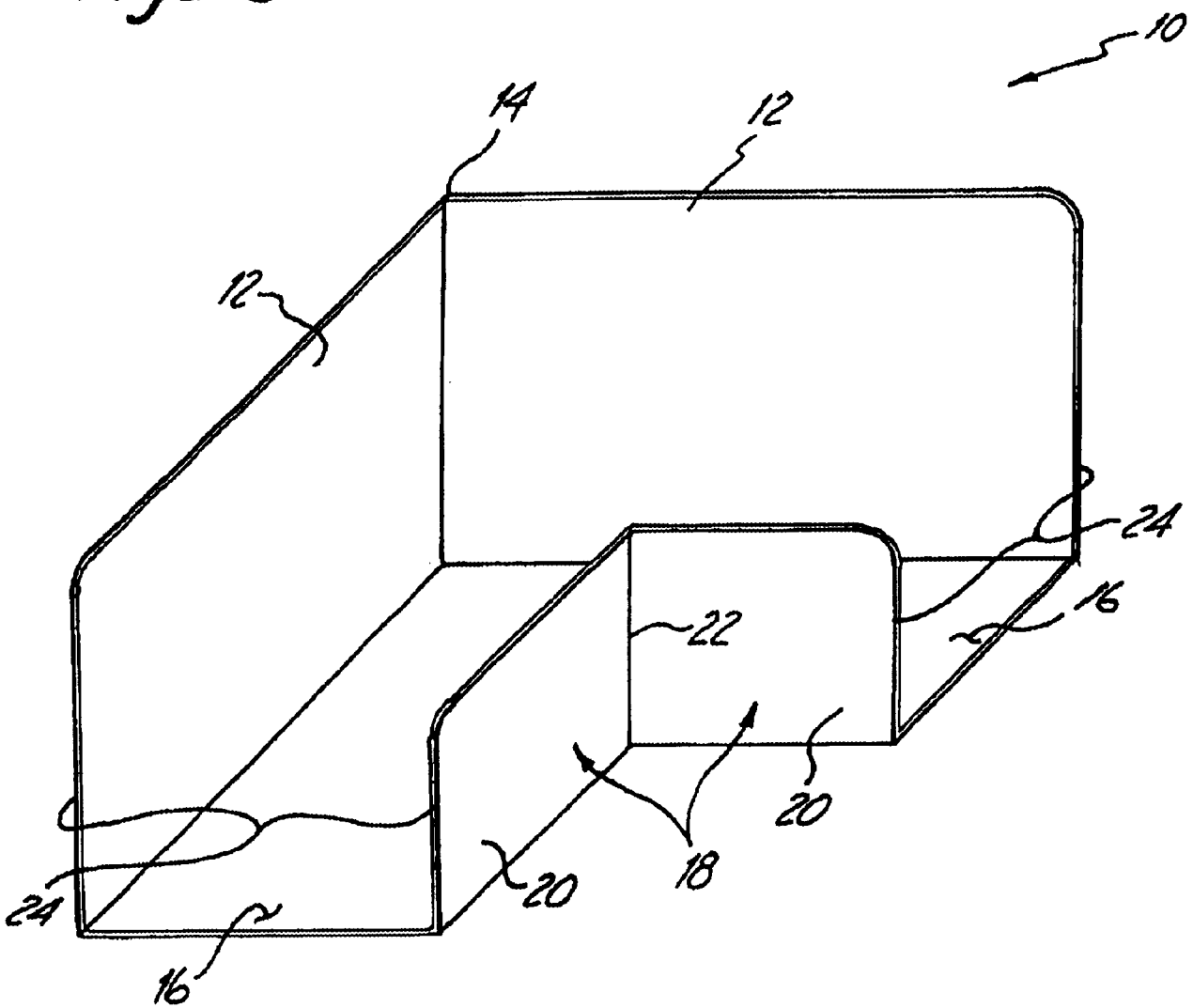
FIG. 1 is a perspective view of the preferred corner piece of the present invention.

Referring now to FIG. 1, there is shown the preferred device 10 of the present invention. The device 10 generally comprises a pair of external walls 12 oriented substantially perpendicular to each other. The walls 12 preferably join each other to form a corner 14. Though the invention could be accomplished without a union to form the corner 14, joining the walls 12 adds stability and thus allows less material to be used.

The walls 12 are also connected to, and held together by, a floor member 16. The floor member 16 add further stability to the walls 12 and prevents the walls 12 from riding up the sides of the foam borders, which rest upon the floor member 16.

An anchor 18 is provided to keep the device 10 in supporting proximity to the corner formed by the foam borders. Preferably, anchor 18 includes two internal walls 20 extending upwardly from the floor member 16. The internal walls 20 may gain stability by joining to form a corner 22.

Figure 2:
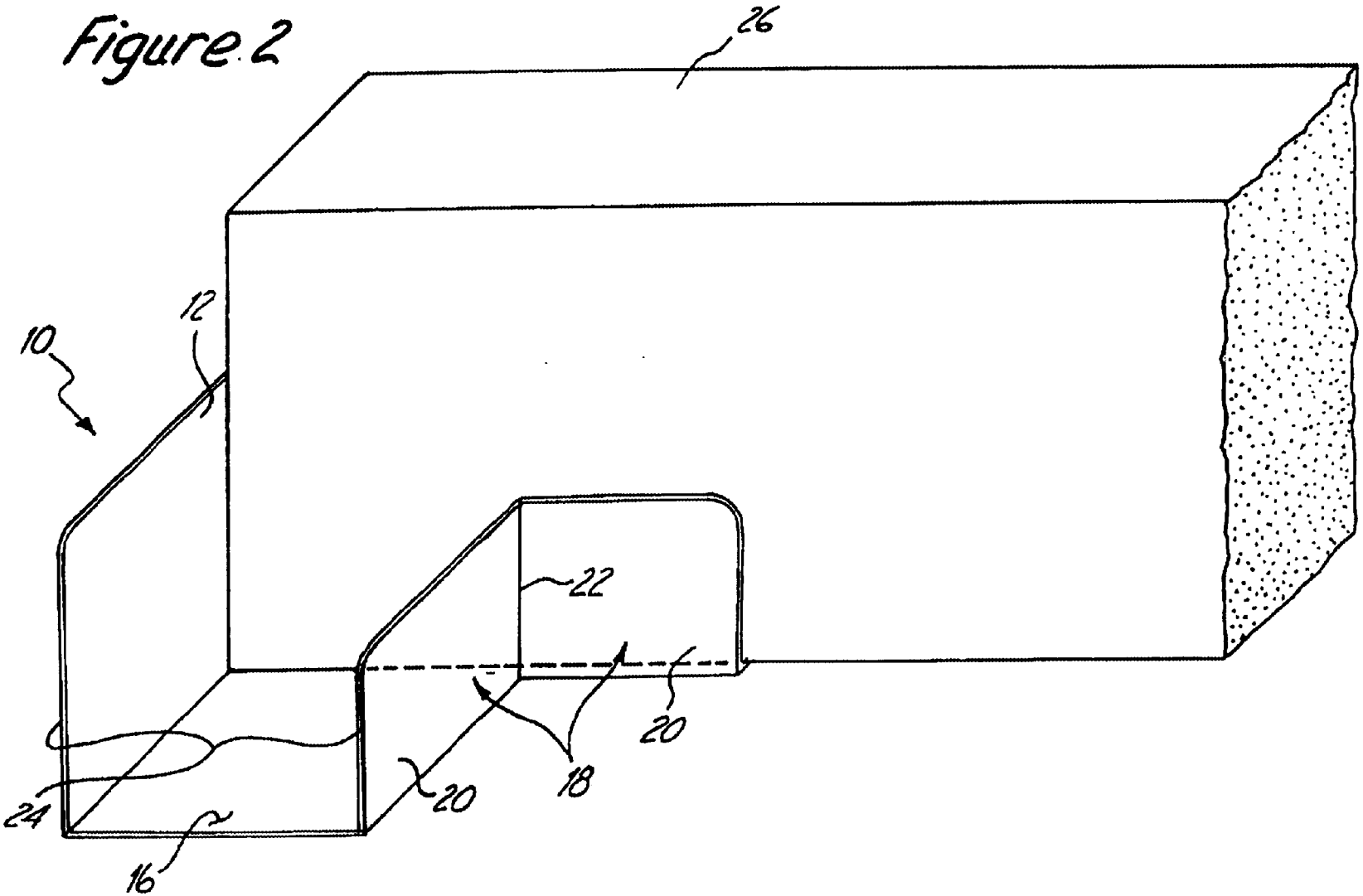
FIG. 2 is a perspective view of the preferred corner piece of the present invention with a single foam border member inserted therein.

Notably, the external walls 12, the internal walls 20 and the floor member 16, together define a channel 24. Looking also at FIG. 2, it can be seen that the channel 24 is sized to accept the foam borders 26 of the soft-sided mattress. The walls 12 are tall enough to adequately support the foam border 26 yet shorter than the border 26 so that a person will not detect the presence of the device 10 when sitting on the bed. The inner walls 20 are even shorter than the external walls 12, primarily for purposes of minimizing material costs.

Figure 3:
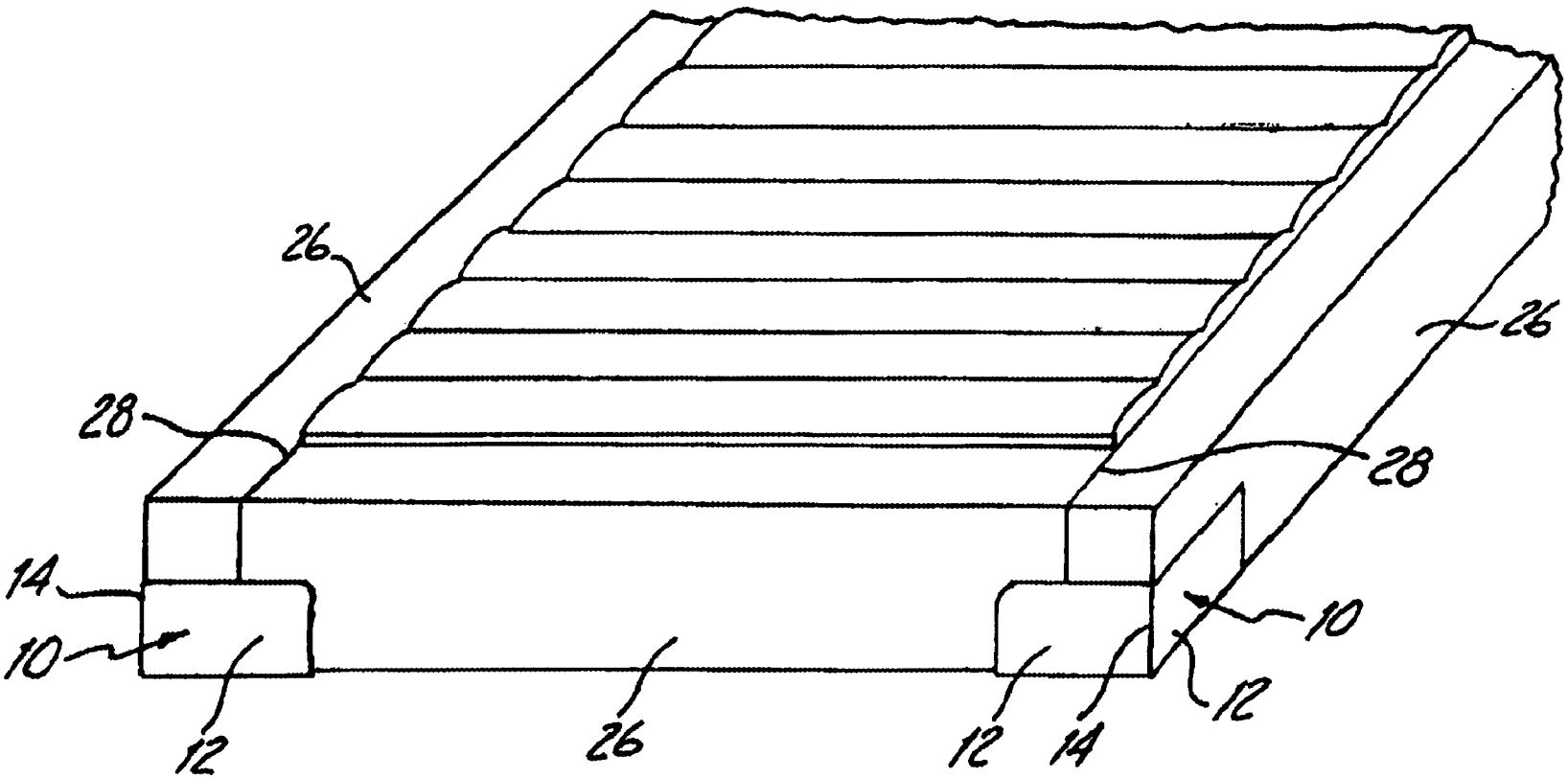
FIG. 3 is a perspective partial view of a fluid-filled mattress having two of the preferred corner pieces of the present invention installed thereon; and, FIG. 4 is a perspective view of an alternative embodiment of a preferred corner piece of the present invention.

FIG. 3 shows the devices 10 maintaining the corners of an assembled soft-sided bed. It can be seen that two borders 26 enter each device 10 and form a butt joint 28 therein. The devices 10 obviate the need for providing covers over the foam borders 26 because fasteners, such as hook and loop fasteners, are no longer needed. It is preferable that each of the devices 10 are formed from a single piece of plastic.

Assembly of the foam borders 26 with the devices 10 includes arranging the foam borders 26 in the channel 24 of the device 10 to form a butt joint 28. The borders 26 are placed on top of the device 10 so that the device 10 is not detected by a person sitting on the bed. The borders 26, and the devices 10 are covered once four of the devices 10 are installed, one on each corner of the mattress.

Figure 4:
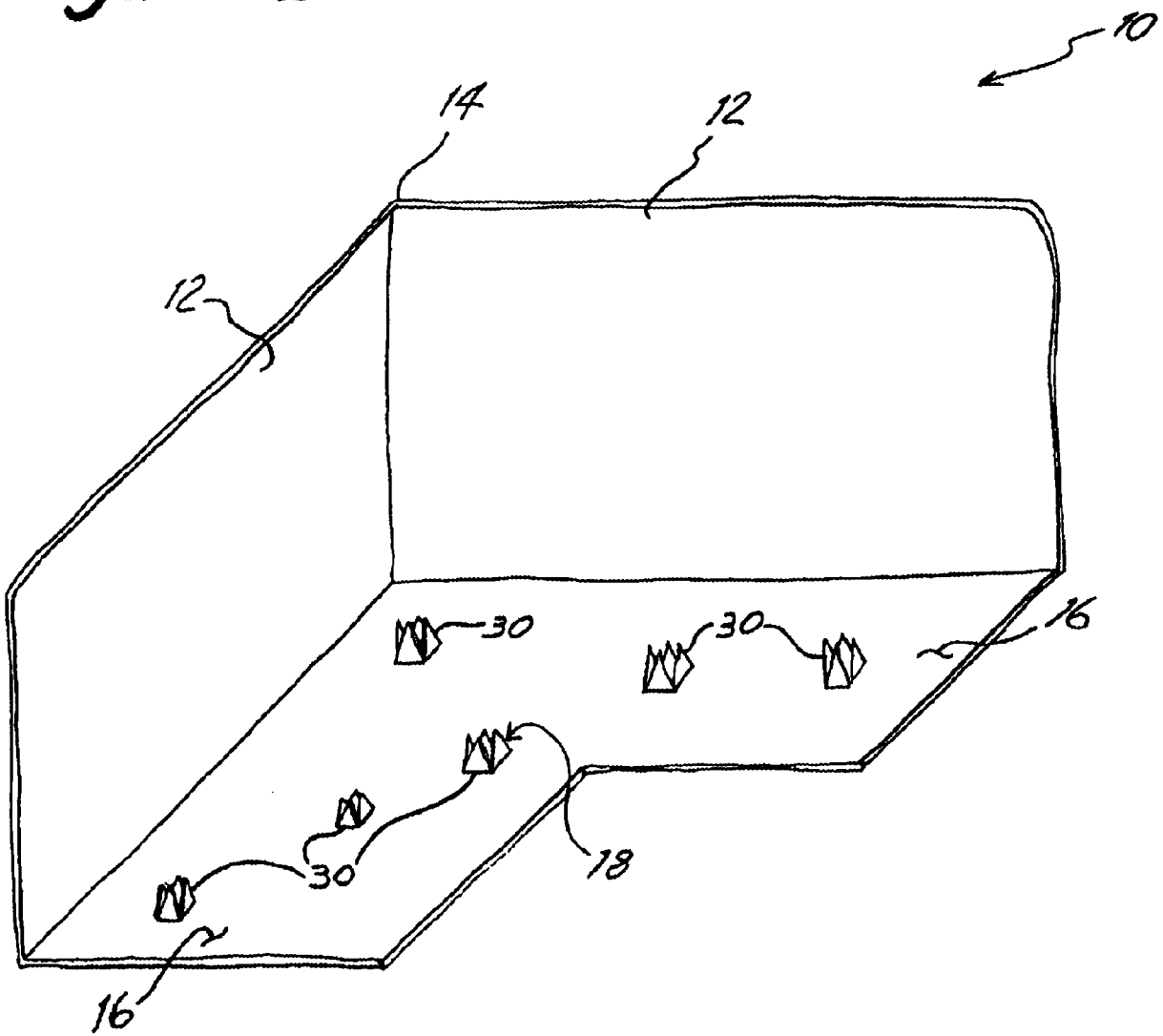

FIG. 4 shows an alternative embodiment of the corner piece 10 in which the anchor 18 comprises a plurality of spikes 30 extending upwardly from the floor member 16. The spikes 30 penetrate the foam borders 26 (FIG. 2) thereby preventing relative movement between the corner piece 10 and the foam borders 26.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. By way of example only, the inner walls 20 of the anchor 18 could be separated such that the corner 22 is not formed. Similarly, the external walls 12 could fail to meet to form the corner 14. Also, the walls 12 and 20 are shown as substantially rectangular though they could comprise a variety of shapes. The butt joints 28 provide for economic manufacturing. However, if desired, alternative joints, such as miter joints, may be used by shaping the borders differently.

Accordingly, the present invention is not limited in the particular embodiments which have been described in detail therein. Rather, reference should be made to the appended claims as indicative of the scope and content of the present invention.

What is claimed is:

1. In combination with a soft-sided mattress, a device for preserving a square corner of the soft-sided mattress comprising:

two external wall constructed and arranged to form a substantially right angle;

a floor member connected to said walls;

an anchor, operably connected to said floor member, useable to keep said walls in close proximity to the square corner of the mattress;

wherein said two external walls are of a height less than a height of said mattress.

2. The device of claim 1 wherein said two external walls are integral with each other.

3. The device of claim 1 wherein said floor member is integral with said two external walls.

4. The device of claim 1 wherein said anchor comprises a first internal wall, connected to said floor member, extending upwardly and parallel to one of said two external walls to define a first channel there between, the first channel sized to accept a first foam member of the soft-sided mattress.

5. The device of claim 4 wherein said internal wall is integral with said floor member.

6. The device of claim 4 wherein said anchor comprises a second internal wall, connected to said floor member, extending upwardly and parallel to the other of said two external walls to define a second channel there between, the second channel sized to accept a second foam member of the soft-sided mattress that is substantially perpendicular to said first foam member.

7. The device of claim 6 wherein said second internal wall is integral with said floor member.

8. The device of claim 6 wherein said second internal wall is integral with said first internal wall.

9. The device of claim 6 wherein said two external walls, said floor member, and said first and second internal walls are all of unitary construction.

10. The device of claim 1 wherein said two external walls, said floor member, and said anchor, comprise plastic.

11. The device of claim 1 wherein said anchor comprises a plurality of spikes protruding from said floor member into the soft sides of the mattress.

* * * * *